US009172138B2

(12) United States Patent
Xue

(10) Patent No.: US 9,172,138 B2
(45) Date of Patent: Oct. 27, 2015

(54) DUAL-FEEDPOINT ANTENNA SYSTEM AND METHOD FOR FEEDPOINT SWITCHOVER OF DUAL-FEEDPOINT ANTENNA SYSTEM

(71) Applicant: Huawei Device Co., Ltd., Shenzhen (CN)

(72) Inventor: Liang Xue, Shenzhen (CN)

(73) Assignee: HUAWEI DEVICE CO., LTD., Shenzhen (CN)

( * ) Notice: Subject to any disclaimer, the term of this patent is extended or adjusted under 35 U.S.C. 154(b) by 214 days.

(21) Appl. No.: 13/970,049

(22) Filed: Aug. 19, 2013

(65) Prior Publication Data

US 2014/0055317 A1 Feb. 27, 2014

(30) Foreign Application Priority Data

Aug. 27, 2012 (CN) ..... 2012 1 0306815

(51) Int. Cl.

| | |
|---|---|
| ***H01Q 3/24*** | (2006.01) |
| ***H01Q 1/50*** | (2006.01) |
| ***H01Q 1/24*** | (2006.01) |
| ***H01Q 9/04*** | (2006.01) |
| ***H01Q 25/00*** | (2006.01) |

(52) U.S. Cl.

CPC ..... *H01Q 3/24* (2013.01); *H01Q 1/243* (2013.01); *H01Q 1/245* (2013.01); *H01Q 3/247* (2013.01); *H01Q 9/045* (2013.01); *H01Q 25/00* (2013.01)

(58) Field of Classification Search

CPC ..... H01Q 3/24; H01Q 25/00; H01Q 9/045; H01Q 1/243

See application file for complete search history.

(56) References Cited

U.S. PATENT DOCUMENTS

| | | | | |
|---|---|---|---|---|
| 2008/0111748 | A1 | 5/2008 | Dunn et al. | |
| 2010/0035567 | A1 | 2/2010 | Vin | |
| 2011/0250928 | A1 * | 10/2011 | Schlub et al. | 455/550.1 |
| 2012/0064954 | A1 * | 3/2012 | Kato | 455/575.7 |
| 2012/0182198 | A1 * | 7/2012 | Larsen et al. | 343/867 |

(Continued)

FOREIGN PATENT DOCUMENTS

| | | | |
|---|---|---|---|
| CN | 1370341 | A | 9/2002 |
| CN | 1612685 | A | 5/2005 |

(Continued)

OTHER PUBLICATIONS

Extended European Search Report received in Application No. 13180624.2-1812 mailed Nov. 4, 2013, 7 pages.

(Continued)

*Primary Examiner* — Trinh Dinh
(74) *Attorney, Agent, or Firm* — Slater & Matsil, L.L.P.

(57) ABSTRACT

A system includes a first feedpoint and a second feedpoint symmetrically disposed on the left and right sides of an antenna on a small board. A first switch, a second switch, and a third switch are disposed on a mainboard. The first switch, the second switch, and the third switch are controlled through a control instruction so that the system is in a first connection state and a second connection state. Signal strength corresponding to the first connection state and signal strength corresponding to the second connection state are detected, and if the signal strength corresponding to the first connection state is greater than the signal strength corresponding to the second connection state, each switch is controlled through an instruction so that the system is in the first connection state, in which the first feedpoint is working. Otherwise, the second feedpoint is working.

16 Claims, 4 Drawing Sheets

(56) References Cited

U.S. PATENT DOCUMENTS

| | | | | |
|---|---|---|---|---|
| 2014/0015719 | A1* | 1/2014 | Ramachandran | 343/745 |
| 2014/0320358 | A1* | 10/2014 | Wong et al. | 343/749 |
| 2015/0048991 | A1* | 2/2015 | Pajona et al. | 343/852 |

FOREIGN PATENT DOCUMENTS

| | | | |
|---|---|---|---|
| CN | 101662070 | A | 3/2010 |
| EP | 0546803 | A1 | 6/1993 |
| EP | 1296407 | A1 | 3/2003 |
| EP | 1335449 | A1 | 8/2003 |
| JP | 05308216 | A | 11/1993 |
| JP | 11205206 | A | 7/1999 |
| JP | 2004023546 | A | 1/2004 |
| JP | 2005006091 | | 1/2005 |

OTHER PUBLICATIONS

International Search Report and Written Opinion received in Application No. PCT/CN2013/081334 mailed Oct. 24, 2013, 10 pages.

* cited by examiner

DUAL-FEEDPOINT ANTENNA SYSTEM AND METHOD FOR FEEDPOINT SWITCHOVER OF DUAL-FEEDPOINT ANTENNA SYSTEM

CROSS-REFERENCE TO RELATED APPLICATION

This application claims priority to Chinese Patent Application No. 201210306815.3 filed on Aug. 27, 2012, which is hereby incorporated by reference in its entirety.

TECHNICAL FIELD

The embodiments of the present invention relate to the antenna technology, and in particular, to a dual-feedpoint antenna system and a method for feedpoint switchover of the dual-feedpoint antenna system.

BACKGROUND

With the development of the communications technologies, more and more operators have shifted their weighing standard of radio performance from total radiated power (Total Radiated Power, hereinafter referred to as TRP) and total isotropic sensitivity (Total Isotropic Sensitivity, hereinafter referred to as TIS) of original free space performance to a requirement on a phantom head (Phantom Head) or even a phantom head and hand (Phantom Head and Hand). Currently, several big operators, such as Vodafone (Vodafone, hereinafter referred to as VDF) and T-Mobile (T-Mobile, hereinafter referred to as TMO) have taken the lead in shifting an original performance requirement of a one-sided phantom head and hand (right phantom head and hand) to a performance requirement of a left and right phantom head and hand. It is predicted that in the near future, a radio performance requirement of a left and right phantom head and hand will become the mainstream requirement of most operators in the market. However, in a traditional antenna solution, a feedpoint is generally located at a certain side of a mainboard, resulting in imbalanced performance of the left and right phantom head and hand. Generally, a difference of the phantom head and hand on two sides is about 3 dB. Therefore, how to balance the difference between the left and right phantom head and hand has become a hot send in this industry.

During the implementation process of the embodiments of the present invention, the inventor finds that in the existing dual-feed antenna technology, separation of low-frequency and high-frequency signals is implemented through dual feedpoints, and the high- and low-frequency signals reach a radio frequency chip respectively through different paths, and resonance of high- and low-frequency antennas are respectively adjusted through a matching circuit in order to broaden their respective bandwidths or to improve the performance of the phantom head and hand, which has a certain effect on broadening the antenna bandwidths and improve the performance of a one-sided phantom head and hand, but has little effect on balancing the performance of the left and right phantom head and head, where it is even possible that the other side of the phantom head and hand deteriorates.

SUMMARY

The embodiments of the present invention provide a dual-feedpoint antenna system and a method for feedpoint switchover of the dual-feedpoint antenna system.

In one aspect, an embodiment of the present invention provides a dual-feedpoint antenna system, including:

an antenna, disposed on a small board, where a first feedpoint and a second feedpoint are symmetrically disposed on the left and right sides of the antenna;

a first switch, disposed on the small board, where the first switch includes a first fixed connection end and a first optional connection end, where the first fixed connection end is connected to one end of a first matching circuit on the small board, and the first optional connection end is connected to the first feedpoint;

a second switch, further disposed on the small board, where the second switch includes a second fixed connection end and a third optional connection end, where the second fixed connection end is connected to one end of a second matching circuit on the small board, and the third optional connection end is connected to the second feedpoint; and a third switch, disposed on a mainboard, where the third switch includes a third fixed connection end, a fifth optional connection end, and a sixth optional connection end; another end of the first matching circuit is connected to the fifth optional connection end, and another end of the second matching circuit is connected to the sixth optional connection end, and the third fixed connection end is connected to a transceiver on the mainboard; where a control line of the first switch, a control line of the second switch, and a control line of the third switch are separately connected to the mainboard;

the system is in a first connection state when the first feedpoint is working, where the first connection state is that the third fixed connection end is connected to the fifth optional connection end, the first fixed connection end is connected to the first optional connection end, and the second fixed connection end is disconnected from the third optional connection end;

the system is in a second connection state when the second feedpoint is working, where the second connection state is that the third fixed connection end is connected to the sixth optional connection end, the second fixed connection end is connected to the third optional connection end, and the first fixed connection end is disconnected from the first optional connection end; and signal strength corresponding to the first connection state and signal strength corresponding to the second connection state are detected, and if the signal strength corresponding to the first connection state is greater than the signal strength corresponding to the second connection state, the first switch, the second switch, and the third switch are controlled through an instruction to switch over to the first connection state, in which the first feedpoint is working; otherwise, the first switch, the second switch, and the third switch are controlled through an instruction to switch over to the second connection state, in which the second feedpoint is working.

In another aspect, an embodiment of the present invention provides a method for feedpoint switchover of a dual-feedpoint antenna system, including:

controlling, through a control instruction, actions of a first switch, a second switch, and a third switch in the system to achieve a first connection state, where the first connection state is that a third fixed connection end is connected to a fifth optional connection end, a first fixed connection end is connected to a first optional connection end, and a second fixed connection end is disconnected from a third optional connection end;

controlling, through a control instruction, the actions of the first switch, the second switch, and the third switch in the system to achieve a second connection state, where the second connection state is that the third fixed connection end is connected to a sixth optional connection end, the second fixed connection end is connected to the third optional connection end, and the first fixed connection end is disconnected from the first optional connection end; and detecting signal strength corresponding to the first connection state and signal strength corresponding to the second connection state, where if the signal strength corresponding to the first connection state is greater than the signal strength corresponding to the second connection state, the first switch, the second switch, and the third switch are controlled through an instruction to switch over to the first connection state, in which a first feedpoint is working; otherwise, the first switch, the second switch, and the third switch are controlled through an instruction to switch over to the second connection state, in which a second feedpoint is working.

In the dual-feedpoint antenna system and the method for feedpoint switchover of the dual-feedpoint antenna system provided by the embodiments of the present invention, by controlling, through a control instruction, a first switch to be on and a second switch to be disconnected so that the system achieves a first connection state, signal strength of the system corresponding to the first connection state is detected; by controlling, through a control instruction, the second switch to be on and the first switch to be disconnected so that the system achieves a second connection state, if the signal strength corresponding to the first connection state is greater than the signal strength corresponding to the second connection state, the first switch, the second switch, and the third switch are controlled through an instruction to switch over to the first connection state, in which the first feedpoint is working; otherwise, the first switch, the second switch, and the third switch are controlled through an instruction to switch over to the second connection state, in which the second feedpoint is working; and by controlling the switches, it is ensured that only a feedpoint on one side is working, and when it is detected that performance of a feedpoint on the other side is better, the system switches over to the feedpoint with higher performance to balance the difference between the left and right phantom head and hand.

BRIEF DESCRIPTION OF DRAWINGS

To illustrate the technical solutions in the embodiments of the present invention or in the prior art more clearly, the accompanying drawings required for describing the embodiments or the prior art are briefly described in the following. Apparently, the accompanying drawings in the following description merely show some embodiments of the present invention, and a person of ordinary skill in the art may still derive other drawings from these accompanying drawings without creative efforts.

DESCRIPTION OF EMBODIMENTS

To make the objectives, technical solutions, and advantages of the embodiments of the present invention more clearly, the following clearly and describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

Figure 1:
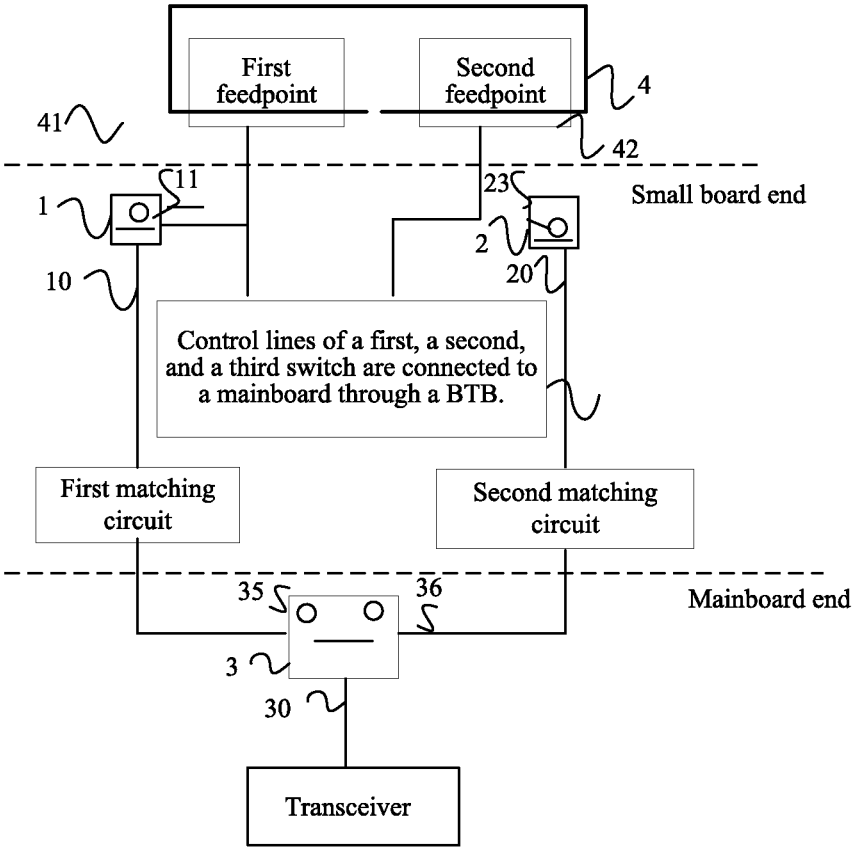
FIG. 1 is a schematic structural diagram of a first embodiment of a dual-feedpoint antenna system according to the present invention.

FIG. 1 is a schematic structural diagram of a first embodiment of a dual-feedpoint antenna system according to the present invention. As shown in FIG. 1, the dual-feedpoint antenna system in this embodiment includes: an antenna 4, disposed on a small board, a first feedpoint 41 and a second feedpoint 42 symmetrically disposed on the left and right sides of the antenna 4, a first switch 1 and a second switch 2 disposed on the small board, and a third switch 3 disposed on a mainboard.

The first switch disposed on the small board includes a first fixed connection end 10 and a first optional connection end 11, where the first fixed connection end 10 is connected to one end of a first matching circuit on the small board, and the first optional connection end 11 is connected to the first feedpoint 41; the second switch 2 is further disposed on the small board, and the second switch 2 includes a fixed connection end 20 and a third optional connection end 23, where the second fixed connection end 20 is connected to a second matching circuit on the small board, and the third optional connection end 23 is connected 42 to the second feedpoint.

The third switch 3 is disposed on the mainboard, where the third switch 3 includes a third fixed connection end 30, a fifth optional connection end 35, and a sixth optional connection end 36, and another end of the first matching circuit is connected to the fifth optional connection end 35 of the third switch 3, another end of the second matching circuit is connected to the sixth optional connection end 36, and the fixed connection end 30 of the third switch 3 is connected to a transceiver on the mainboard.

A control line of the first switch 1, a control line of the second switch 2, and a control line of the third switch 3 are separately connected to the mainboard, and the mainboard sends an instruction through the control lines to each switch to control the connection and disconnection of each switch and to further control the work of the feedpoint.

Specifically, the mainboard controls, through a control instruction, the first switch 1 and the third switch 3 to be on simultaneous and the second switch 2 to be disconnected, and at the same time, the third fixed connection end 30 of the third switch 3 is connected to the fifth optional connection end 35, the first fixed connection end 10 of the first switch 1 is connected to the first optional connection end 11, and the second fixed connection end 20 of the second switch 2 is disconnected from the third connection end 23, so that the system is in a first connection state, in which the first feedpoint is working; the mainboard controls, through a control instruction, the second switch 2 and the third switch 3 to be on simultaneous and the first switch to be disconnected, and at the same time, the third fixed connection end 30 of the third switch 3 is connected to the sixth optional connection end 36, the second fixed connection end 20 of the second switch is connected to the third optional connection end 23, and the first fixed connection end 10 of the first switch 1 is disconnected from the first optional connection end 11, so that the system is in a second connection state, in which the second feedpoint is working.

Signal strength corresponding to the first connection state and signal strength corresponding to the second connection state are detected, where if the signal strength corresponding to the first connection state is greater than the signal strength corresponding to the second connection state, the first switch, the second switch, and the third switch are controlled through an instruction to switch over to the first connection state, in which the first feedpoint is working; otherwise, the first switch, the second switch, and the third switch are controlled through an instruction to switch over to the second connection state, in which the second feedpoint is working.

The dual-feedpoint antenna system provided by the embodiment of the present invention: by controlling, through a control instruction, a first switch to be on and a second switch to be disconnected so that the system is in a first connection state, detects signal strength of the system corresponding to the first connection state; by controlling, through a control instruction, the second switch to be on and the first switch to be disconnected so that the system is in a second connection state, detects the signal strength of the system corresponding to the second connection state; and by controlling the switches, ensures that only a feedpoint on one side is working, and when it is detected that performance of a feedpoint on the other side is better, switches over to the feedpoint with higher performance.

Figure 2:
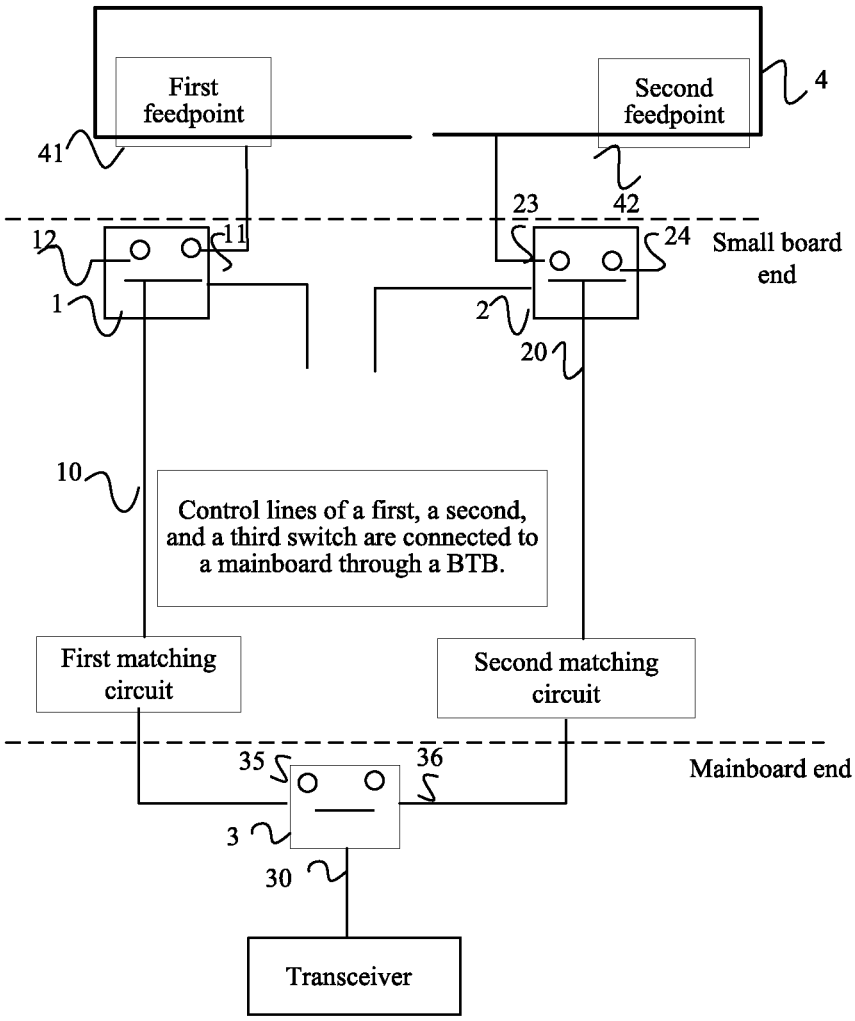
FIG. 2 is a schematic structural diagram of a second embodiment of a dual-feedpoint antenna system according to the present invention.

FIG. 2 is a schematic structural diagram of a second embodiment of a dual-feedpoint antenna system according to the present invention. As shown in FIG. 2, the dual-feedpoint antenna system according to the embodiment includes: an antenna 4, disposed on a small board, a first feedpoint 41 and a second feedpoint 42 symmetrically disposed on the left and right sides of the antenna 4, a first switch 1 and a second switch 2 disposed on the small board, and a third switch 3 disposed on a mainboard.

The first switch 1 is disposed on the small board, where the first switch 1 includes a first fixed connection end 10, a first optional connection end 11, and a second optional connection end 12, and the first fixed connection end 10 is connected to one end of a first matching circuit on the small board, the first optional connection end 11 is connected to the first feedpoint 41, and the second optional connection end 12 is suspended. The second switch 2 is also disposed on the small board, where the second switch 2 includes a second fixed connection end 20, a third optional connection end 23, and a fourth optional connection end 24, and the second fixed connection end 20 is connected to a second matching circuit on the small board, the third optional connection end 23 is connected 42 to the second feedpoint, and the fourth optional connection end 24 is suspended.

The third switch 3 is disposed on the mainboard, where the third switch 3 includes a third fixed connection end 30, a fifth optional connection end 35, and a sixth optional connection end 36, and another end of the first matching circuit is connected to the fifth optional connection end 35 of the third switch 3, another end of the second matching circuit is connected to the sixth optional connection end 36, and the fixed connection end 30 of the third switch 3 is connected to a transceiver on the mainboard.

A control line of the first switch 1, a control line of the second switch 2, and a control line of the third switch 3 are separately connected to the mainboard, and the mainboard sends an instruction through the control lines to each switch to control turn-on and turn-off of each switch and to further control work of a feedpoint.

In this embodiment, the first feedpoint 41 and the second feedpoint 42 are symmetrically disposed on the left and right sides of the antenna, and the first switch 1 is disposed for the first feedpoint 41, the second switch 2 is disposed for the second feedpoint 41, and the control lines of the first switch 1 and the second switch 2 are connected to the mainboard through board to board connectors (Board to Board Connectors, hereinafter referred to as BTB). The third switch 3 is also on the mainboard, and the first switch 1, the second switch 2, and the third switch 3 are, for example, single-pole double-throw (single-pole double-throw, hereinafter referred to as SP2T) switches. When the first feedpoint is working, the fixed connection end 30 of the SP2T 3 is connected to the fifth optional connection end 35, the first fixed connection end 10 of the SP2T 1 is connected to the first optional connection end 11, the SP2T 1 starts working, the second fixed connection end 20 of the SP2T 2 is connected to the fourth optional connection end 24, that is, connected to the suspended end, and the SP2T 2 is disconnected. On the contrary, when the second feedpoint 42 is working, the fixed connection end 30 of the SP2T 3 is connected to the sixth optional connection end 36, the second fixed connection end 20 of the SP2T 2 is connected to the third optional connection end 23, the SP2T 2 starts working, the first fixed connection end 10 of the SP2T 1 is connected to the second optional connection end 12, that is, connected to the suspended end, and the SP2T 1 is disconnected.

As a high-frequency bandwidth of the dual-feedpoint antenna system is not optimized yet, only the 850/1900 MHZ frequency bands are compared for now. In a specific test scenario, generally, when the first feedpoint is working, in a high frequency band, performance of the right phantom head and hand is higher than performance of the left phantom head and hand, and in a low frequency band, the performance of the left phantom head and hand is higher than the performance of the right phantom head and hand; when the second feedpoint is working, in the high frequency band, the performance of the left phantom head and hand is higher than the performance of the right phantom head and hand, and in the low frequency band, the performance of the right phantom head and hand is higher than the performance of the left phantom head and hand. For example, in a test scenario of the left phantom head and hand, the first feedpoint is working, and at this time, it is detected that the performance of the left phantom head and hand of the first feedpoint is lower. By turning on and off switches to perform feedpoint switchover and after the switchover, the second feedpoint is working, and because in the high frequency band, the performance of the left phantom head and hand is higher than that of the right phantom head and hand when the second feedpoint is working, the 2-3 dB's disparity of the left phantom head and hand when the first feedpoint is working is compensated, which balances the performance of the left and right phantom head and hand.

TABLE 1

| | First Feedpoint Is Working | | Second Feedpoint Is Working | |
|---|---|---|---|---|
| Frequency (MHZ) | Right phantom head and hand (dB) | Left phantom head and hand (dB) | Right phantom head and hand (dB) | Left phantom head and hand (dB) |
| 824 | −11.4 | −10.8 | −10.1 | −11.9 |
| 836 | −11.8 | −11.0 | −10.3 | −12.2 |
| 849 | −12.5 | −11.3 | −10.6 | −12.7 |
| 869 | −13.1 | −11.5 | −10.8 | −13.0 |
| 880 | −13.7 | −11.9 | −11.1 | −13.3 |
| 882 | −13.6 | −11.7 | −10.9 | −13.1 |
| 894 | −14.1 | −11.7 | −11.3 | −13.6 |
| 1850 | −8.8 | −13.6 | −14.6 | −8.3 |
| 1880 | −8.6 | −13.7 | −14.7 | −8.0 |
| 1910 | −8.4 | −14.1 | −15.1 | −7.7 |
| 1920 | −8.5 | −14.5 | −15.5 | −7.7 |

TABLE 1-continued

| Frequency (MHZ) | First Feedpoint Is Working: Right phantom head and hand (dB) | First Feedpoint Is Working: Left phantom head and hand (dB) | Second Feedpoint Is Working: Right phantom head and hand (dB) | Second Feedpoint Is Working: Left phantom head and hand (dB) |
|---|---|---|---|---|
| 1930 | −8.5 | −14.6 | −15.5 | −7.7 |
| 1950 | −8.5 | −14.9 | −15.6 | −7.7 |
| 1960 | −8.7 | −15 | −15.5 | −7.8 |
| 1980 | −8.8 | −15.2 | −15.4 | −7.8 |
| 1990 | −8.6 | −15.1 | −15.4 | −7.8 |

As shown in table 1, taking the 1850 MHz frequency as an example, in the measurement scenario of the right phantom head and hand, when the first feedpoint is working, the performance of the right phantom head and hand is −8.8 dB, and when the second feedpoint is working, the performance of the right phantom head and hand is −14.6 dB (which is 5.8 dB lower than the performance of the right phantom head and hand when the first feedpoint is working). Accordingly, we may, through software control, make the first feedpoint work and disconnect the second feedpoint in a right phantom head and hand scenario, and at this time, detected performance of the right phantom head and hand is −8.8 dB; similarly, in a left phantom head and hand measurement scenario, for example, the performance of the left phantom head and hand when the first feedpoint is working is −13.6 dB, and the performance of the left phantom head and hand when the second feedpoint is working is −8.3 dB (which is 5.3 dB's higher than the performance when the first feedpoint is working). Accordingly, we may, through software control, make the second feedpoint work and disconnect the first feedpoint in a left phantom head and hand scenario, and at this time, detected performance of the left phantom head and hand is −8.3 dB. By controlling the switchover of the first feedpoint one and the second feedpoint in their corresponding right/left phantom head and hand test scenarios, the approximate 5 dB's disparity of the one-sided feedpoint left and right phantom head and hand is compensated.

As verified by experiments, as shown in table 2, it can be known that: in a conventional antenna solution, performance of a one-sided phantom head and hand is better. However, as there is a 2-3 dB disparity of performance of the phantom head and hand on two sides, performance of the phantom head and hand on the other side is lower than that in a dual-feedpoint antenna solution (about 1 dB lower); in a centered feedpoint dual loop (Dual Loop) solution, the phantom head and hand on two sides do not bear a great difference, in which low-frequency performance is higher than that in a dual-feedpoint antenna, but high-frequency performance is over 2 dB lower than that in a dual-feedpoint antenna solution. Therefore, upon comprehensive consideration: comprehensive performance of a dual-feedpoint antenna is the optimized, with subsequent optimization in an aspect of an antenna pattern, overall performance of which may be further improved.

It should be noted that: table 1 and table 2 only contain part of data obtained in a test result in the implementation process of the embodiment of the present invention, and the present invention is not limited thereto. In the actual operation process, data may vary due to different test conditions, instrument errors, and human factors.

In the foregoing embodiments of the present invention, whether the feedpoint is switched may be determined by disposing a sensor (Sensor) beside the feedpoint, or by respectively connecting the first feedpoint and the second feedpoint through software control and comparing, at the instant when the terminal is connected to the base station, level values (RSSI) received by the two feedpoints, and by switching, through switches, over to a feedpoint side with a stronger signal. However, the determining whether the feedpoint can be switched in the present invention is not limited thereto.

In an existing antenna solution, no matter on which side the feedpoint is placed, a performance imbalance problem of the left and right phantom head and hand is inevitable. In the dual-feedpoint antenna system provided by the embodiment, the first feedpoint and the second feedpoint is symmetrically disposed on the left and right sides of the small board, and it is ensured through switch switchover control that only a

TABLE 2

| Frequency (MHZ) | Conventional Antenna Solution: Right phantom head and hand (dB) | Conventional Antenna Solution: Left phantom head and hand (dB) | Centered Feedpoint Antenna Solution: Right phantom head and hand (dB) | Centered Feedpoint Antenna Solution: Left phantom head and hand (dB) | Dual-Feedpoint Antenna Solution: Right phantom head and hand (dB) | Dual-Feedpoint Antenna Solution: Left phantom head and hand (dB) |
|---|---|---|---|---|---|---|
| 824 | −11.4 | −11.5 | −8.2 | −9.4 | −10.1 | −10.8 |
| 836 | −11.5 | −11.6 | −8.6 | −9.7 | −10.3 | −11.0 |
| 849 | −11.6 | −11.8 | −9.0 | −10.3 | −10.6 | −11.3 |
| 869 | −11.6 | −12.0 | −9.3 | −10.5 | −10.8 | −11.5 |
| 880 | −11.8 | −12.2 | −9.7 | −10.9 | −11.1 | −11.9 |
| 882 | −11.6 | −12.1 | −9.6 | −10.7 | −10.9 | −11.7 |
| 894 | −11.5 | −12.0 | −9.5 | −10.8 | −11.3 | −11.7 |
| 1850 | −9.6 | −7.4 | −12.1 | −10.1 | −8.8 | −8.3 |
| 1880 | −9.4 | −7.4 | −11.8 | −10.1 | −8.6 | −8.0 |
| 1910 | −9.3 | −7.3 | −11.1 | −9.7 | −8.4 | −7.7 |
| 1920 | −9.3 | −7.1 | −10.6 | −9.4 | −8.5 | −7.7 |
| 1930 | −9.4 | −7.4 | −10.8 | −9.6 | −8.5 | −7.7 |
| 1950 | −9.4 | −7.4 | −10.4 | −9.5 | −8.5 | −7.7 |
| 1960 | −9.5 | −7.5 | −10.1 | −9.4 | −8.7 | −7.8 |
| 1980 | −9.1 | −7.2 | −9.5 | −9.1 | −8.8 | −7.8 |
| 1990 | −9.6 | −7.6 | −9.7 | −9.2 | −8.6 | −7.8 |

feedpoint on one side is working, which may balance the difference between the left and right phantom head and hand. In addition, in the dual-feedpoint antenna system provided by the embodiment of the present invention, antenna cabling is basically symmetric, which ensures that an antenna resonance location when one of the feedpoints on two sides is working is basically the same as that when the other of the feedpoints is working.

Figure 3:
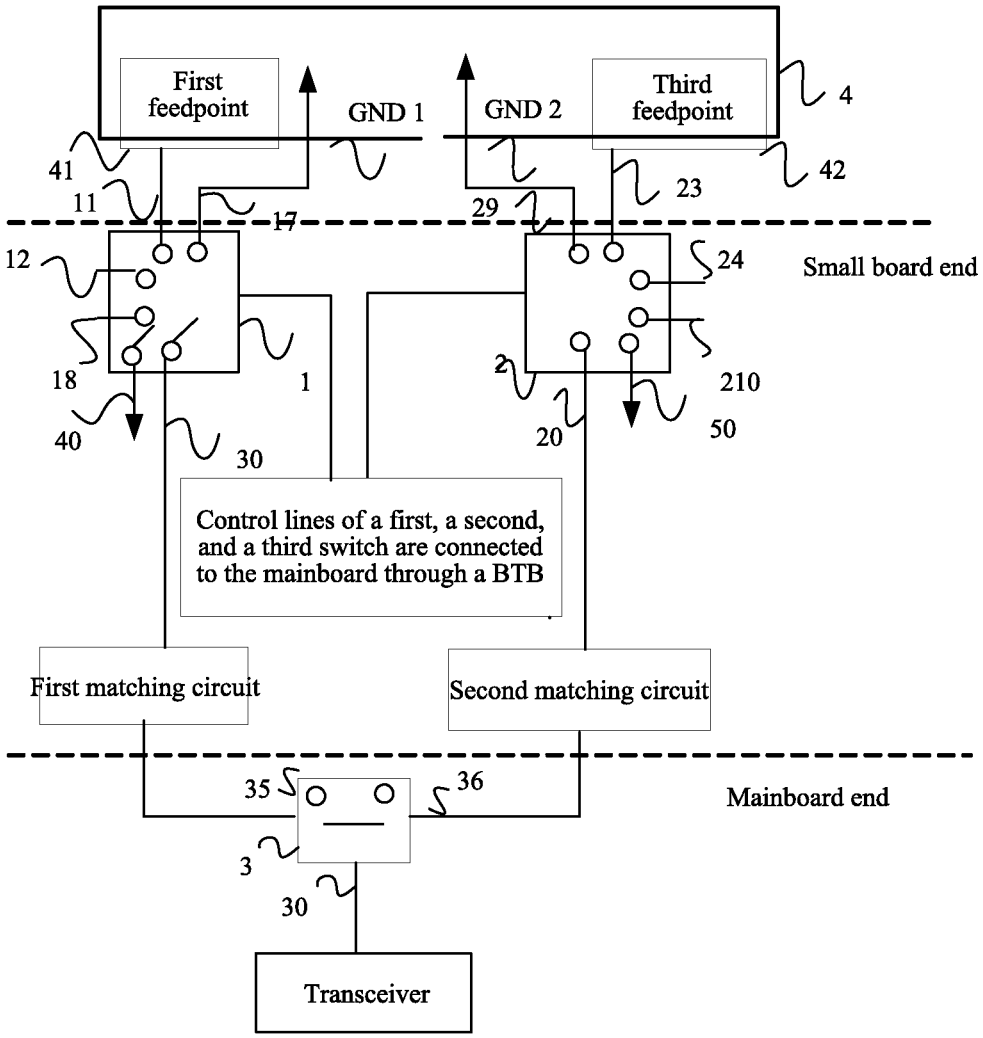
FIG. 3 is a schematic structural diagram of a third embodiment of a dual-feedpoint antenna system according to the present invention.

FIG. 3 is a schematic structural diagram of a third embodiment of a dual-feedpoint antenna system according to the present invention. As shown in FIG. 3, the dual-feedpoint antenna system according to the embodiment includes: an antenna 4, disposed on a small board, a first feedpoint 41 and a second feedpoint 42 symmetrically disposed on the left and right sides of the antenna 4, a first switch 1 and a second switch 2 disposed on the small board, and a third switch 3 disposed on a mainboard. The dual-feedpoint antenna system in this embodiment is similar to the embodiment in FIG. 2. For identical parts, please refer to FIG. 2, which is not described herein again. The difference between the dual-feedpoint antenna system in this embodiment and that in the foregoing system embodiment 2 is in that: in this embodiment, a first ground point GND1 is disposed beside the first feedpoint 41, and a second ground point GND2 is disposed beside the second feedpoint 42. In addition, in this embodiment, the first switch 1 and the second switch 2 are double-pole double-throw switches (Double Pole Double Throw, hereinafter referred to as DPDT). For details, please refer to FIG. 3.

As shown in FIG. 3, the first ground point GND1 is disposed near the location of the first feedpoint 41 on the antenna; correspondingly, the first switch 1 further includes a fourth fixed connection end 40, a seventh optional connection end 17, and an eighth optional connection end 18, which form a double-pole double-throw switch together with a first fixed connection end 10, a first optional connection end 11, and a second optional connection end 12. The GND1 is connected to the seventh optional connection end 17, the fourth fixed connection end 40 is connected to the ground end of the mainboard, and the eighth optional connection end 18 is suspended.

Similarly, the second ground point GND2 is disposed near the location of the second feedpoint 42 on the antenna; correspondingly, the second switch 2 further includes a fifth fixed connection end 50, a ninth optional connection end 29, and a tenth optional connection end 210, which form a double-pole double-throw switch together with a second fixed connection end 20, a third optional connection end 23, and a fourth optional connection end 24. The GND2 is connected to the ninth optional connection end 29, the fifth fixed connection end 50 is connected to the ground end of the mainboard, and the tenth fixed connection end 210 is suspended.

The dual-feedpoint antenna system provided by the embodiment can ensure, through switch control, that only a feedpoint on one side is working, and when it is detected that the performance of the feedpoint on the other side is higher, switches over to a feedpoint with higher performance. In addition, in this embodiment, antenna cabling is basically symmetric, which ensures that an antenna resonance location when one of the feedpoints on two sides is working is basically the same as that when the other of the feedpoints is working. Besides, because a ground point is added beside each feedpoint, an antenna bandwidth and cabling flexibility are increased.

Figure 4:
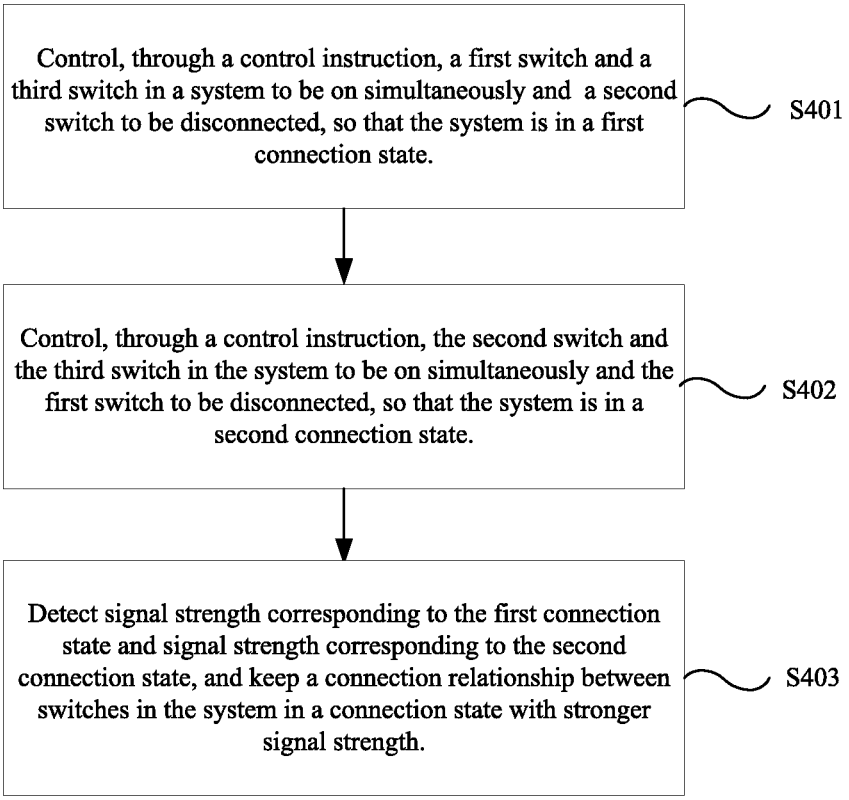
FIG. 4 is a flowchart of a first embodiment of a method for feedpoint switchover of a dual-feedpoint antenna system according to the present invention.

FIG. 4 is a flowchart of a first embodiment of a method for feedpoint switchover of a dual-feedpoint antenna system according to the present invention. The method for the feedpoint switchover of the dual-feedpoint antenna system in this embodiment applies to the dual-feedpoint antenna system in FIG. 1, and the following describes the detailed steps of this method with reference to the drawing signs in FIG. 1.

Step S401: Control, through a control instruction, a first switch and a third switch in the system to be on simultaneously and a second switch to be disconnected, so that the system is in a first connection state.

In this step, the first connection state, for example, may be a working state of the first feedpoint 41: the third fixed connection end 30 of the third switch 3 is connected to the fifth optional connection end 35, the first fixed connection end 10 of the first switch 1 is connected to the first optional connection end 11, the second fixed connection end 20 of the second switch 2 is disconnected from the third optional connection end 23, that is, when the first feedpoint 41 is working, the second feedpoint 42 is disconnected, ensuring that only a feedpoint on one side is working in the system.

Step S402: Control, through a control instruction, the second switch and the third switch in the system to be on simultaneously and the first switch to be disconnected, so that the system is in a second connection state.

In this step, the second connection state, for example, may be a working state of the second feedpoint 42: the third fixed connection end 30 of the third switch 3 is connected to the sixth optional connection end 36, the second fixed connection end 20 of the second switch 2 is connected to the third optional connection end 23, the first fixed connection end 10 of the first switch 1 is disconnected from the first optional connection end 11, that is, when the second feedpoint 42 is working, the first feedpoint 41 is disconnected, ensuring that only a feedpoint on one side is working in the system.

Step S403: Detect signal strength corresponding to the first connection state and signal strength corresponding to the second connection state, and keep a connection relationship between switches in the system in a connection state with stronger signal strength.

If the signal strength corresponding to the first connection state is greater than the signal strength corresponding to the second connection state, the first switch, the second switch, and the third switch are controlled through an instruction to switch over to the first connection state, in which the first feedpoint is working; otherwise, the first switch, the second switch, and the third switch are controlled through an instruction to switch over to the second connection state, in which the second feedpoint is working.

In the foregoing embodiments of the present invention, whether the feedpoint may be switched may be determined by disposing a sensor (Sensor) beside the feedpoint, or by respectively connecting the first feedpoint and the second feedpoint through software control and comparing, at the instant when the terminal is connected to the base station, level values (RSSI) received by the two feedpoints, and by switching, through switches, over to a feedpoint side with a stronger signal. However, the determining whether the feedpoint may be switched in the present invention is not limited thereto.

The feedpoint switchover method in the dual-feedpoint antenna system provided by this embodiment ensures that only a feedpoint on one side is working by switch switchover control and may balance the difference between the left and right phantom head and hand.

Please refer to FIG. 2. In an embodiment of the method for the feedpoint switchover of the dual-feedpoint antenna system of the present invention that applies to FIG. 2, the first connection state, for example, may be a working state of the first feedpoint 41: the third fixed connection end 30 of the third switch 3 is connected to the fifth optional connection end 35, the first fixed connection end 10 of the first switch 1 is connected to the first optional connection end 11, the second fixed connection end 20 of the second switch 2 is connected to the fourth optional connection end 24, that is, when the first feedpoint 41 is working, the second feedpoint 42 is disconnected, ensuring that only a feedpoint on one side is working in the system.

The second connection state, for example, may be a working state of the second feedpoint 42: the third fixed connection end 30 of the third switch 3 is connected to the sixth optional connection end 36, the second fixed connection end 20 of the second switch 2 is connected to the third optional connection end 23, the first fixed connection end 10 of the first switch 1 is connected to the second optional connection end 12, that is, when the second feedpoint 42 is working, the first feedpoint 41 is disconnected, ensuring that only a feedpoint on one side is working in the system.

The system detects signal strength when the first feedpoint 41 is working and signal strength when the second feedpoint 42 is working, and by controlling turn-on and turn-off of the switches, keeps the system in a connection state with strong signal strength.

Please refer to FIG. 3. In an embodiment of feedpoint switchover of the dual-feedpoint antenna system of the present invention that applies to FIG. 3, the first ground point GND1 is disposed beside the first feedpoint 41, and the second ground point GND2 is disposed beside the second feedpoint 42. Besides, the first switch 1 and the second switch 2 are double-pole double-throw switches (double pole DoubleThrow, hereinafter referred to as DPDT). The first connection state further includes that the seventh optional connection end 17 of the first switch 1 is connected to the fourth fixed connection end 40, and the tenth optional connection end 210 of the second switch 2 is connected to the fifth fixed connection end 50, that is, when the first feedpoint 41 is working, the second feedpoint 42 is disconnected; the second connection state further includes that the eighth optional connection end 18 of the first switch 1 is connected to the fourth fixed connection end 40, and the ninth optional connection end 29 of the second switch 2 is connected to the fifth fixed connection end 50, that is, when the first feedpoint 41 is disconnected, the second feedpoint 42 is working.

In this embodiment, the antenna cabling is basically symmetric, which ensures that an antenna resonance location when one of the feedpoints on two sides is working is basically the same as that when the other of the feedpoints is working. Besides, as a ground point is added beside each feedpoint, the antenna bandwidth and the cabling flexibility are increased.

The dual-feedpoint antenna system and the switchover method for its feedpoint provided by the embodiments of the present invention may ensure that only a feedpoint on one side is working by switch control and when it is detected that the performance of the feedpoint on the other side is higher, may switch over to the feedpoint with higher performance. In addition, in this embodiment, the antenna cabling is basically symmetric, which ensures that an antenna resonance location when one the feedpoints on two sides is working is basically the same as that when the other of the feedpoints is working. Besides, a ground point may further be added beside each feedpoint to increase the antenna bandwidth and the cabling flexibility.

A person of ordinary skill in the art should understand that all or part of the steps of the method specified in any embodiment of the present invention may be implemented by a program instructing relevant hardware. The program may be stored in a computer readable storage medium. When the program runs, the program executes the steps of the method specified in any embodiment above. The storage medium may be any medium capable of storing program codes, such as a ROM, a RAM, a magnetic disk, or an optical disk.

Finally, it should be noted that the foregoing embodiments are merely intended for describing the technical solutions of the present invention other than limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof; such modifications or replacements do not make the essence of corresponding technical solutions depart from the scope of the technical solutions of the embodiments of the present invention.

The invention claimed is:

1. A dual-feedpoint antenna system, comprising:

an antenna, disposed on a small board, wherein a first feedpoint and a second feedpoint are symmetrically disposed on left and right sides of the antenna;

a first switch disposed on the small board, wherein the first switch comprises a first fixed connection end and a first optional connection end, the first fixed connection end being connected to one end of a first matching circuit on the small board, and the first optional connection end being connected to the first feedpoint, and wherein the first switch further comprises a fourth fixed connection end connected to a ground end of a mainboard and a seventh optional connection end connected to a first ground point on the antenna near the first feedpoint;

a second switch disposed on the small board, wherein the second switch comprises a second fixed connection end and a third optional connection end, the second fixed connection end being connected to one end of a second matching circuit on the small board, and the third optional connection end being connected to the second feedpoint, and wherein the second switch further comprises a fifth fixed connection end connected to the ground end of the mainboard and a ninth optional connection end connected to a second ground point on the antenna near the second feedpoint;

a third switch disposed on the mainboard, wherein the third switch comprises a third fixed connection end, a fifth optional connection end, and a sixth optional connection end, another end of the first matching circuit being connected to the fifth optional connection end, another end of the second matching circuit being connected to the sixth optional connection end, and the third fixed connection end being connected to a transceiver on the mainboard;

wherein a control line of the first switch, a control line of the second switch, and a control line of the third switch are separately connected to the mainboard;

wherein the system is in a first connection state when the first feedpoint is working, the third fixed connection end being connected to the fifth optional connection end, the first fixed connection end being connected to the first optional connection end, and the second fixed connection end being disconnected from the third optional connection end in the past connection state, and wherein the first ground point is connected to the ground end of the mainboard through the fourth fixed connection end and seventh optional connection end when the system is in the first connection state;

wherein the system is in a second connection state when the second feedpoint is working, the third fixed connection end being connected to the sixth optional connection end, the second fixed connection end being connected to the third optional connection end, and the first fixed connection end being disconnected from the first optional connection end in the second connection state, and wherein the second ground point is connected to the ground end of the mainboard through the fifth fixed connection end and ninth optional connection end when the system is in the second connection state; and wherein the mainboard is configured to detect signal strength corresponding to the first connection state and signal strength corresponding to the second connection state and, if the signal strength corresponding to the first connection state is greater than the signal strength corresponding to the second connection state, to control the first switch, the second switch, and the third switch to switch over to the first connection state, in which the first feedpoint is working, if the signal strength corresponding to the first connection state is not greater than the signal strength corresponding to the second connection state, to control the first switch, the second switch, and the third switch to switch over to the second connection state, in which the second feedpoint is working.

2. The system according to claim 1, wherein the mainboard is further configured to control the first switch, the second switch and the third switch through an instruction.

3. The system according to claim 2, wherein the first switch further comprises a second optional connection end, wherein the second optional connection end is suspended;

the second switch further comprises a fourth optional connection end, wherein the fourth optional connection end is suspended;

when the system is in the first connection state, the third fixed connection end is connected to the fifth optional connection end, the first fixed connection end is connected to the first optional connection end, and the second fixed connection end is connected to the fourth optional connection end; and when the system is in the second connection state, the third fixed connection end is connected to the sixth optional connection end, the second fixed connection end is connected to the third optional connection end, and the first fixed connection end is connected to the second optional connection end.

4. The system according to claim 2, wherein the first switch further comprises an eighth optional connection end, which forms a double-pole double-throw switch together with the first fixed connection end, the first optional connection end, the second optional connection end, the fourth fixed connection end, and the seventh optional connection end the eighth optional connection end being suspended.

5. The system according to claim 4, wherein the second switch further comprises a tenth optional connection end, which forms a double-pole double-throw switch together with the second fixed connection end, the third optional connection end, the fourth optional connection end, a fifth fixed connection end, and a ninth optional connection end the tenth optional connection end being suspended.

6. The system according to claim 1, wherein the first switch further comprises a second optional connection end, wherein the second optional connection end is suspended;

the second switch further comprises a fourth optional connection end, wherein the fourth optional connection end is suspended;

when the system is in the first connection state, the third fixed connection end is connected to the fifth optional connection end, the first fixed connection end is connected to the first optional connection end, and the second fixed connection end is connected to the fourth optional connection end; and when the system is in the second connection state, the third fixed connection end is connected to the sixth optional connection end, the second fixed connection end is connected to the third optional connection end, and the first fixed connection end is connected to the second optional connection end.

7. The system according to claim 1, wherein the first switch further comprises an eighth optional connection end, which forms a double-pole double-throw switch together with the first fixed connection end, the first optional connection end, the second optional connection end, the fourth fixed connection end, and the seventh optional connection end, the eighth optional connection end being suspended.

8. The system according to claim 7, wherein the second switch further comprises a tenth optional connection end, which forms a double-pole double-throw switch together with the second fixed connection end, the third optional connection end, the fourth optional connection end, a fifth fixed connection end, and a ninth optional connection end, the tenth optional connection end being suspended.

9. A method for feedpoint switchover based on a dual-feedpoint antenna system, the method comprising:

controlling, through a first control instruction, actions of a first switch, a second switch, and a third switch in the system to achieve a first connection state, wherein during the first connection state, a third fixed connection end is connected to a fifth optional connection end, a first fixed connection end is connected to a first optional connection end, a first ground point on an antenna near a first feedpoint of the antenna is connected to a ground end of a mainboard through the first switch, and a second fixed connection end is disconnected from a third optional connection end;

controlling, through a second control instruction, actions of the first switch, the second switch, and the third switch in the system to achieve a second connection state, wherein, during the second connection state, the third fixed connection end is connected to a sixth optional connection end, the second fixed connection end is connected to the third optional connection end, a second ground point on the antenna near a second feedpoint of the antenna is connected to the ground end of the mainboard through the second switch, and the first fixed connection end is disconnected from the first optional connection end;

detecting signal strength corresponding to the first connection state and signal strength corresponding to the second connection state;

if the signal strength corresponding to the first connection state is greater than the signal strength corresponding to the second connection state, switching, through the first instruction, the first switch, the second switch, and the third switch to the first connection state in which the first feedpoint is working, and if the signal strength corresponding to the first connection state is not greater than the signal strength corresponding to the second connection state, switching, through the second instruction, the first switch, the second switch, and the third switch to the second connection state, in which the second feedpoint is working.

10. The method according to claim 9, wherein controlling the actions of the first switch, the second switch, and the third switch in the system to achieve the first connection state comprise controlling the third fixed connection end to connect to the fifth optional connection end, the first fixed connection end to connect to the first optional connection end, and the second fixed connection end to connect to a fourth optional connection end.

11. The method according to claim 10, wherein controlling the actions of the first switch, the second switch, and the third switch in the system to achieve the second connection state comprise controlling the third fixed connection end to connect to the sixth optional connection end, the second fixed connection end to connect to the third optional connection end, and the first fixed connection end to connect to a second optional connection end.

12. The method according to claim 11, wherein, in the first connection state, a seventh optional connection end is connected to a fourth fixed connection end, and a tenth optional connection end is connected to a fifth fixed connection end.

13. The method according to claim 12, wherein, in the second connection state, an eighth optional connection end is connected to the fourth fixed connection end, and a ninth optional connection end is connected to the fifth fixed connection end.

14. The method according to claim 9, wherein controlling the actions of the first switch, the second switch, and the third switch in the system to achieve the second connection state comprise controlling the third fixed connection end to connect to the sixth optional connection end, the second fixed connection end to connect to the third optional connection end, and the first fixed connection end to connect to a second optional connection end.

15. The method according to claim 9, wherein, in the first connection state, a seventh optional connection end is connected to a fourth fixed connection end, and a tenth optional connection end is connected to a fifth fixed connection end.

16. The method according to claim 15, wherein, in the second connection state, an eighth optional connection end is connected to the fourth fixed connection end, and a ninth optional connection end is connected to the fifth fixed connection end.

* * * * *